US005078835A

United States Patent [19]

Schiel et al.

[11] Patent Number: 5,078,835

[45] Date of Patent: Jan. 7, 1992

[54] LEDGE FOR RESILIENTLY SUPPORTING A DRAINAGE WIRE OF A PAPER MAKING MACHINE

[75] Inventors: Christian Schiel, Heidenheim; Helmut Grimm, Ellwangen; Robert Wolf, Herbrechtingen, all of Fed. Rep. of Germany

[73] Assignee: J.M. Voith GmbH, Fed. Rep. of Germany

[21] Appl. No.: 711,665

[22] Filed: Jun. 6, 1991

[30] Foreign Application Priority Data

Jun. 22, 1990 [DE] Fed. Rep. of Germany ..... 4019884

[51] Int. Cl.[5] ..... D21F 1/54; D21F 1/24

[52] U.S. Cl. ..... 162/352; 162/354; 162/374

[58] Field of Search ..... 162/352, 354, 374, 301, 162/273

[56] References Cited

U.S. PATENT DOCUMENTS

| | | | |
|---|---|---|---|
| 3,017,930 | 1/1962 | Dunlop | 162/352 |
| 3,027,940 | 4/1962 | Dunlop | 162/352 |
| 4,559,105 | 12/1985 | Sennett et al. | 162/352 |
| 4,865,692 | 9/1989 | Kade et al. | 162/352 |

FOREIGN PATENT DOCUMENTS

| | | | |
|---|---|---|---|
| 3153305 | 10/1986 | Fed. Rep. of Germany | 162/301 |
| 69885 | 12/1985 | Finland | 162/301 |
| 89/02499 | 3/1989 | PCT Int'l Appl. | 162/301 |

*Primary Examiner*—Karen M. Hastings

*Attorney, Agent, or Firm*—Ostrolenk, Faber, Gerb & Soffen

[57] ABSTRACT

A ledge for resiliently supporting a paper making machine wire has a head ledge which extends across the direction of travel of the wire and over which the wire can slide. The head ledge is rigidly connected to a movable support ledge which also extends across the direction of travel of the wire and is guided on a stationary support structure. Between the movable support ledge and the stationary structure there is a resilient push device which can displace the movable support ledge together with the head ledge between a position of rest away from the wire and an operating position in which the head ledge is pressed with a predetermined force against the wire. The stationary structure has several guide arms distributed over the length of the support ledge which are the exclusive means for guiding the movable support ledge. Several guide arms arranged in pairs are provided which grip around the support ledge, in the manner of a clamp.

20 Claims, 2 Drawing Sheets

LEDGE FOR RESILIENTLY SUPPORTING A DRAINAGE WIRE OF A PAPER MAKING MACHINE

BACKGROUND OF THE INVENTION

The present invention relates to a ledge for resiliently supporting a wire screen in the region of the twin wire zone of a twin wire former of a paper making machine.

A ledge which resiliently supports a wire drainage screen or wire, is sometimes referred to herein merely as a resilient ledge. A typical twin wire former, preferably of a paper manufacturing machine, has resilient ledges installed. In the twin wire zone, a plurality of rigidly arranged ledges are provided inside the loop of one wire, for instance, at the bottom of an upwardly draining suction box. These ledges are arranged one behind the other in the direction of travel of the wire over the ledges, and generally they are rather small distances apart. All of the ledges extend transversely of the path of the wire over the entire cross machine width of the wire. Furthermore, a plurality of resilient ledges are also provided in the loop of the other wire.

The resiliency of the resilient ledges provides the following result. For instance, upon an increase of the amount of pulp suspension that is introduced between the two rotating loop wires, the resiliently supported ledges can yield somewhat. This eliminates the danger, which could occur if only rigidly supported ledges were used, of the occurrence of a back up, at the start of the twin wire zone, in the fiber suspension fed and/or in that suspension present between the two wires. Such a back up could destroy the layers of fiber in the web that had been formed up to then on one or on both wires.

The desired action is obtained, among other ways, by the resilient ledges being thrust with a predetermined force against the respective wire. This redetermined force is produced by a resilient push device, for instance, by a pneumatic pressure cushion or by several of such pressure cushions. In this way, a given draining pressure, which can increase from ledge to ledge, is established in the fiber suspension, which is still partially liquid. It is desired that a drainage pressure once established remain as far as possible constant upon a change in the thickness of the layer of suspension between the wires. The thickness of the layer of suspension can be changed by changing the amount of suspension fed or by changing the drainage behavior of the fiber suspension. Automatic adaptation of the web forming device to such changing conditions is therefore desired.

International Application WO 89/02499 discloses a resilient ledge, which includes a head ledge that is relatively wide in the direction of travel of the wire. A plurality of grooves are provided in the head ledge in effect so that the head ledge in effect forms a group of ledges. The head ledge rests on a movable support ledge having a cross section of the shape of a downwardly open U. Via two pneumatic pressure cushions, the head ledge rests on a support which is rigidly fastened in the machine.

TAPPI Proceedings 1988 Annual Meeting, pages 75–80, disclose arrangements with ledges which are relatively narrow in the direction of travel of the wire and which also serve for resiliently supporting a wire. However, those ledges are only shown diagrammatically.

Resilient ledges are also known from Federal Republic of Germany Patent 31 53 305. These ledges, however, are arranged in a curved part of the twin wire zone. At the starting end of the curved part, both wires are deflected on a rigid ledge which is part of an end wall of a box present in the opposite wire. This rigid ledge can cause a back up, as already described above. Furthermore, in each case a head ledge is connected there via a joint with a movable support ledge and that joint is subject to wear since it is exposed to the pulp water. The movable support ledges are guided in a stationary support, which is merely schematically indicated.

SUMMARY OF THE INVENTION

The object of the present invention is to create a resilient ledge of relatively narrow structural shape which, despite the fact that it is arranged in the wet, pulp residue filled atmosphere of the paper making machine, is free of the danger of jamming as a result of dirtying the places where the movable support ledge is guided in a stationary structure.

This object is achieved with the invention, wherein it is no longer attempted, for instance by using a substantially U-shaped structure of the movable support ledge, to keep the pulp water away from the places where the movable support ledge is guided in the stationary structure. Instead, only a few support and guide arms extending from the stationary structure are distributed along the length of the movable support ledge. The ends of these guide arms carry guide surfaces of relatively small area, which are preferably slide guide surfaces. These surfaces are able to strip or knock off the dirt, for instance, fiber residues, which has settled on the movable support ledge, during each displacement of the movable support ledge. Therefore, an automatic cleaning occurs periodically so that the danger of jamming is completely, or at least substantially, eliminated.

It is particularly advantageous to develop the guide arms in pairs, like a clamp, and so that several pairs of guide arms grip around the opposite sides of the movable support ledge, e.g. the top and bottom of a horizontal ledge. The guide arms extend in the direction of movement of the support ledge and their guide surfaces project to the ledge. In this connection, it is advantageous for the individual guide arms to have two fingers which contact the support ledge only at the ends of the fingers. Seen in cross section, the movable support ledge therefore extends from the one finger to the other finger of the guide arm. The cross-sectional shape of the movable support ledge is relatively narrow in height, i.e. across the direction of shifting of the ledge. As a result, the complete ledge is relatively narrow in cross section, which permits adjacent ledges to be arranged at a close distance apart along the path of the wire in the paper making machine. Furthermore, the movable support ledge is relatively rigid or highly resistant to bending, which improves the uniformity of the pressure of application of the ledge against the wire over the cross machine width.

Under certain circumstances, it may be sufficient if only the guide arms that are arranged over one side, i.e. the top or bottom of the movable support ledge, have the two fingers. In that case, the opposite side could be provided with simple guide arms which contact the movable support ledge over only a single guide surface. However, providing each of the two guide arms of a pair thereof with two fingers that contact the support ledge is of more universal use.

It is possible to provide the ledge of the invention with push devices of different construction, for instance a plurality of pneumatic cylinders which are distributed over the width of the machine, or a pneumatic tube shaped pressure cushion. The invention contemplates the use of a specially developed pneumatic pressure cushion, which is the object of German Patent Application P 40 09 628.9 (Voith File P 4651). Particular features of this pressure cushion are described below. These features cause the force of application of the resilient ledge against one of the two wires to remain constant with substantially greater precision than up to now and upon a change in the thickness of the layer of suspension between the two wires. There is a constant application of force to the wire regardless of the distance of the movable support ledge from its position of rest. This pressure cushion improves the uniformity of the ledge application pressure over the width of the machine, particularly if the stationary structure which supports the pressure cushion experiences a sap or, for instance, does not extend precisely on a straight line as a result of manufacturing inaccuracies.

If the two wires travel in at least approximately horizontal direction and if the ledge of the invention is positioned to support the lower wire from the bottom, whereby the support ledge is movable in the vertical directions, it may be sufficient for the movable support ledge to be moved back into its position of rest solely under the force of gravity. Frequently, however, it is necessary to provide a source of return force in order to return the movable support ledge into its position of rest. This would be the case when the ledge of the invention is to be pressed from above against a substantially horizontally traveling wire or when the ledge is moved horizontally to press against wires that travel substantially vertically. In such cases, a few springs distributed over the length of the ledge are the preferable source of return force However, these springs should have as flat spring characteristic as possible so that the uniformity of the ledge application force over the width of the machine is disturbed as little as possible by the springs.

The source of the return force, preferably the springs, should detach themselves, i.e. eliminate application of force, from the movable support ledge shortly before the movable support ledge reaches its position of rest. In other words, the maximum stroke of the source of return force is less than the maximum stroke of the movable support ledge. This coupled with the fact that, in the invention, only the above described guide arms are provided for guiding the movable support ledge, after the movable support ledge reaches its position of rest, possibly together with the head ledge, it can be easily removed from the paper machine by moving it in the direction of the length of the ledge. This may be necessary, for instance, in order to replace the head ledge with another one. This removal can be done even when the paper making machine is operating since the return springs are not active in the position of rest of the movable support ledge.

Other features and advantages of the present invention will become apparent from the following refers to the accompanying drawings.

DESCRIPTION OF THE PREFERRED EMBODIMENTS

Figure 1:
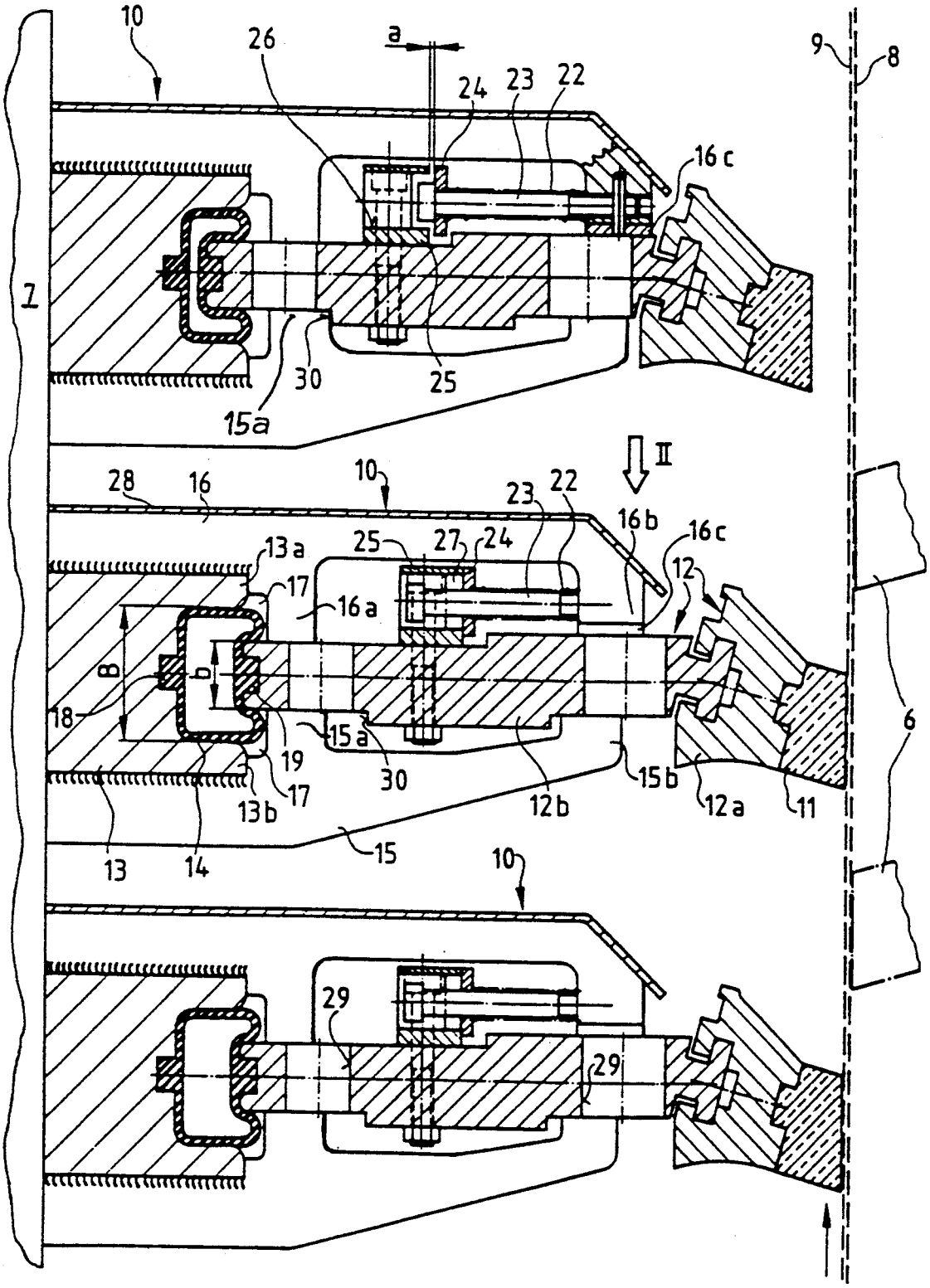
FIG. 1 is a cross section through a group of resilient ledges which are arranged along two drainage wire screens travelling approximately vertically upwards.

In FIG. 1, two approximately vertically extending drainage wire screens or wires 8 and 9 of a twin wire end of a wire section of a paper making machine are indicated symbolically by dashed lines. One of the wires slides over two of a total of three resilient ledges 10. The uppermost of the three ledges is shown in its rest position, while the others are shown in their operating positions. The heads 6 of opposite ledges which support the other wire 8 are indicated by dash-dot lines, with the remainder of the ledges 6 not shown.

Each of the ledges 10 includes a ceramic head ledge 11 which is fastened on a movable support ledge 12 behind its head ledge 11. The ledge 12 is in turn of two parts in the embodiment shown, i.e. it is an assembly of two parts **12*a* and 12*b*. The ceramic head ledge 11 is rigidly connected to the adjacent part 12*a*. The parts 12*a* and 12*b* are fastened to each other in an easily detachable manner by means of the illustrated T-connection, wherein ledge part 12*a* is slid onto the end of part 12*b***.

A stationary structure serves for guiding and supporting the movable support ledge 12. It comprises a cross member 13, which extends over the width of the machine and is fastened in the machine frame on a drainage box 7, or the like. On the cross member 13 are arranged a few pairs of opposed guide arms 15, 16 (see FIG. 2), which are distributed over the cross machine length of the support ledge. The arm pairs grip around the movable support ledge 12 in the manner of a clamp. Thus, the movable support ledge 12 is guided by several lower guide arms 15 and by several upper guide arms 16. For this purpose, each guide arm 15, 16 has relatively small guide slide surfaces on the ends of its two contact fingers **15*a* and 15*b*, and 16*a* and 16*b* which are located toward the opposite ends of the arms 15 and 16. On the end of each contact finger, there can be a replaceable slide disk 16*c*, as shown for example on the finger 16*b***.

Between the movable support ledge 12 and the cross member 13 there is a tubular pressure cushion 14, which also extends over the entire cross matching length of the ledge. The outer surface of the support ledge 12, which contacts the pressure cushion 14, is the contact surface of the support ledge. Its width b over the height of the ledge, as shown in FIG. 1, is substantially less than the total width B over the height of the edge of the pressure cushion 14. The total width B is determined by the width of a groove present in the cross member 13, and that groove is limited by two side walls or arms **13*a* and 13*b* of the member 13 which project forward from the rear surface of the supporting cross member and toward the wire. The side walls 13*a* and 13*b* support the sides of the pressure cushion or more precisely, as shown in FIG. 1, the top and the bottom thereof. It is important that a free space 17, into which a loop of the deformed pressure cushion 14 can extend, be provided on each side of the contact surface of the movable support ledge 12**.

Figure 2:
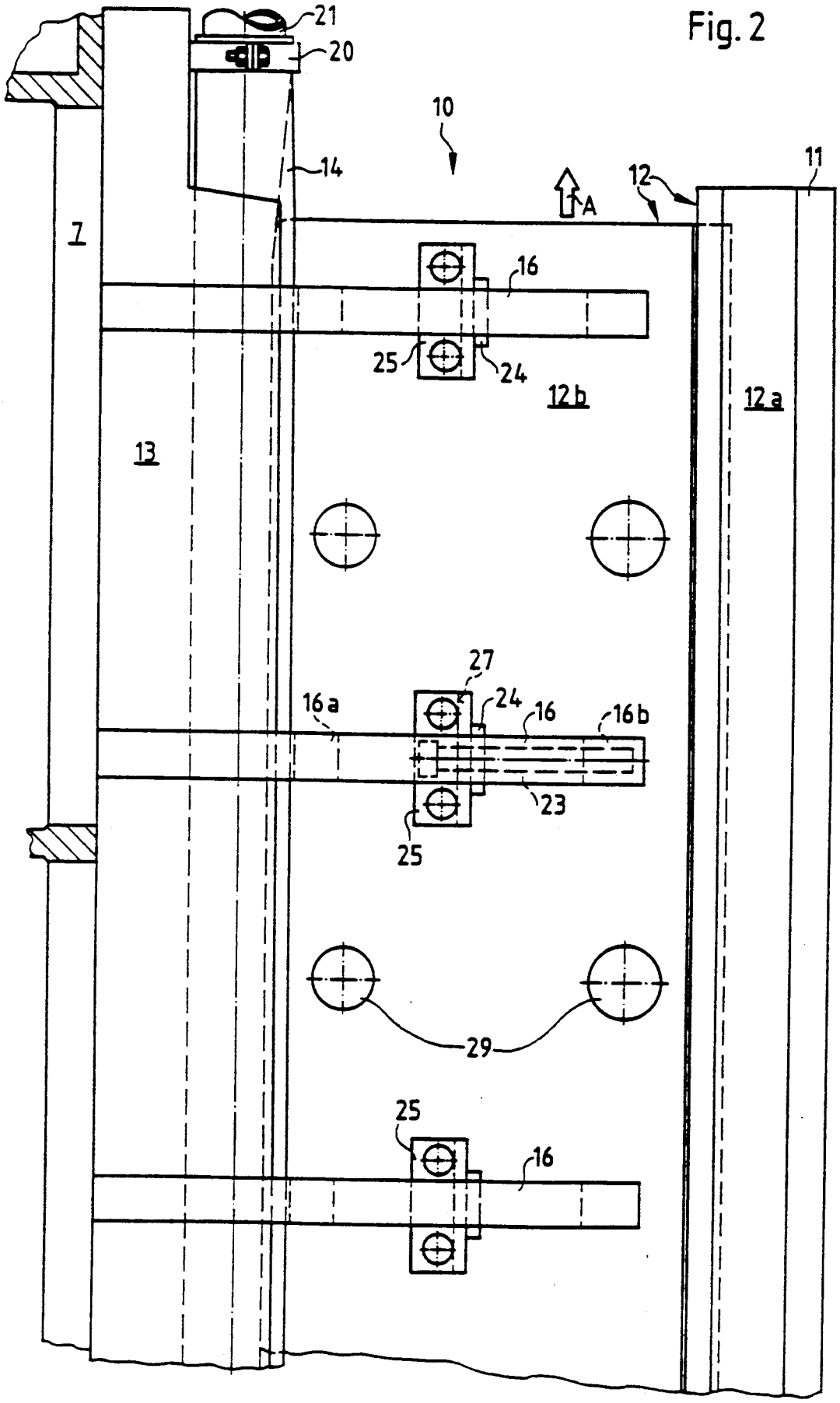
FIG. 2 is a partial view of one of the ledges of FIG. 1, in the direction of arrow II in FIG. 1.

For guiding the pressure cushion 14, for instance, upon its introduction into the device, two oppositely projecting longitudinal ribs 18 and 19 are provided on the pressure cushion. The ribs 19 and 18 engage in corresponding longitudinal grooves in the inwardly facing contact surface of the support ledge 12 and the outwardly facing contact surface of the cross member 13, respectively. FIG. 2 shows one of the two ends of the pressure cushion, which is connected by a hose clamp 20 to the compressed air line 21. When the movable support ledge 12 is to be pulled out of the paper making machine (for instance, in the direction of the arrow A of FIG. 2) starting from its position of rest, the pipe clamp 20 and the compressed air line 21 are first removed.

For returning the movable support ledge 12 out of the operating position and into the position of rest, a compression coil spring 22, guided on a screw 23, is provided on each upper guide arm 16. As long as the pressure cushion 14 is acted on by compressed air, the compression spring 22 rests via a disk 24 on a bracket 25 fastened on the support ledge 12. The bracket 25 has a recess 26 which receives the head of the screw 23 as long as the support ledge 12 is in the operating position. When the interior of the pressure cushion 14 is not pressurized, then the springs 22 push the movable support ledge 12 in the direction to the left toward its position of rest. The relaxation of the springs 22 comes to an end, however, when the disk 24 reaches the head of the screw 23. The position of rest of the support ledge 12 is determined by a stop 30. When the stop 30 is active, i.e. when the stop 30 contacts the finger 15*a*, there is a distance a between the disk 24 and the bracket 25. Furthermore, the head of the screw 23 is now in a longitudinal groove 27 in the bracket 25 so that the above mentioned removal of the movable support ledge 2 is now possible without this being prevented by the compression spring 22 and the screw 23.

A cover plate 28 has been omitted from FIG. 2. The support ledge 12 has several openings, for instance holes 29, so that water can discharge downward.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A ledge for resilient support of the drainage wire screen in the wire zone of a paper making machine, wherein the wire screen has a travel direction and a cross machine direction across the wire screen travel direction, the ledge comprising:

a head ledge extending in the cross machine direction and including a surface on which the wire can slide, a movable support ledge to which the head ledge is attached, and the support ledge extending in the cross machine direction;

a stationary support structure at the side of the head ledge away from the wire screen, and the movable support ledge being movable toward and away from the wire screen with respect to the stationary support structure; the movable support ledge having an operating position with the head ledge pressed against the wire screen at a predetermined force and having a rest position with the head ledge away from the wire screen;

the movable support ledge including a portion thereof that extends back from the head ledge away from the wire screen and toward the stationary support structure, and the support ledge portion having opposite supportable sides by which the support ledge can be supported by the support structure, and the supportable sides being oriented so that the movable support ledge can move between its operating and rest positions while being supported at the supportable sides;

the stationary support structure including a plurality of guide arms distributed over the length of the support ledge in the cross machine direction, the guide arms engaging at least one of the supportable sides of the support ledge portion and on that supportable side, the guide arms serving as the exclusive means for guiding the path of movement of the support ledge and the head ledge for movement between the operating and rest positions; and a resilient push device connected between the stationary support structure and the movable support ledge for selectively displacing the movable support ledge from the position of rest to the operating position and permitting the support ledge to return to the rest position from the operating position.

2. The ledge of claim 1, wherein the head ledge is rigidly connected to the movable support ledge and they move together.

3. The ledge of claim 1, wherein the guide arms of the stationary support structure are positioned for engaging both of the opposite supportable sides of the support ledge portion and are the exclusive means for guiding the path of movement of the movable support ledge and the head ledge for movement between the operating and rest positions.

4. The ledge of claim 3, wherein the support structure includes a first plurality of the guide arms extending to one of the supportable sides of the portion of the support ledge and a second plurality of the guide arms extending to the opposite supporting side of the portion of the support ledge, and the guide arms at the opposite supportive sides of the movable support ledge are adapted for engaging the support ledge portion as a clamp around the support ledge.

5. The ledge of claim 4, wherein the first and second pluralities of guide arms are arranged in respective pairs, with one guide arm of each pair being at one of the opposite supportable sides of the support ledge portion.

6. The ledge of claim 5, wherein the guide arms on at least one supportable side of the support ledge portion each comprise an arm extending over the respective supportable side of the support ledge portion toward the head ledge and a plurality of fingers spaced apart along the guide arm in the direction toward the head ledge, the fingers extending into contact with the respective supportable side of the support ledge, and the fingers being the sole contact between that guide arm and the support ledge portion supportable side.

7. The ledge of claim 4, wherein the guide arms on at least one supportable side of the support ledge portion each comprise an arm extending over the respective supportable side of the support ledge portion toward the head ledge and a plurality of fingers spaced apart along the guide arm in the direction toward the head ledge, the fingers extending into contact with the respective supportable side of the support ledge, and the fingers being the sole contact between that guide arm and the support ledge portion supportable side.

8. The ledge of claim 4, wherein the respective guide arm at each supportable side of the support ledge portion extends over the respective supportable side and toward the head ledge and there are a respective plurality of fingers from the respective guide arm extending into contact with the respective supportable side of the support ledge portion and those fingers being the only portions of the respective guide arms by which the guide arms engage the supportable sides of the support ledge portion.

9. The ledge of claim 6, wherein the plurality of fingers on the guide arm comprises two of the fingers spaced apart in the direction along the guide arm toward the head ledge.

10. The ledge of claim 6, further comprising stops defined on the support ledge on the supportable side thereof contacted by the fingers, and the stops being positioned for abutting the fingers for limiting the stroke of the movement of the movable support ledge.

11. The ledge of claim 3, further comprising cooperating stops on the support ledge and the guide arms for limiting the stroke of the movement of the support ledge with respect to the wire screen.

12. The ledge of claim 3, wherein the resilient push device comprises a pressurizable pressure cushion extending substantially over the cross machine direction and disposed between the stationary support structure and the movable ledge, each of the support structure and the movable ledge having respective and opposed contact surfaces against which the pressure cushion rests; on at least one of the support structure and the movable support ledge, the width of the respective contact surface, in the direction through the supportable sides of the movable ledge, being less than the total width of the pressure cushion for defining a free space into which the part of the pressured cushion beyond the respective contact surface can be deformed.

13. The ledge of claim 12, wherein the width of only one of the opposed contact surfaces is smaller than the width of the pressure cushion: the width of the other of the two contact surfaces is wider than the width of the first of the contact surfaces, and the one of the support structure and the support ledge on which the other of the contact surfaces is defined includes side walls which extend transversely to the respective contact surfaces, extend toward the pressure cushion and provide lateral support for the pressure cushion in addition to the support for the pressure cushion at both of the contact surfaces.

14. The ledge of claim 12, wherein the pressure cushion has a respective longitudinal rib in the region of at least one of the two contact surfaces and the respective contact surface at which the rib is formed on the pressure cushion has a respective groove therein in which the rib on the pressure cushion is received, the groove and the rib extending in the cross machine direction.

15. The ledge of claim 3, further comprising return means for urging the support ledge and the head ledge to normally return to the rest position thereof away from the wire screen.

16. The ledge of claim 15, wherein the ledge return means comprises a spring.

17. The ledge of claim 16, wherein the ledge return means spring has a flat spring characteristic.

18. The ledge of claim 16, wherein the spring is positioned to engage the movable support ledge as the movable support ledge is in the operating position and toward the wire screen and the spring is so shaped and positioned as to separate from the movable support ledge as the movable support ledge is returning to the rest position.

19. The ledge of claim 15, wherein the ledge return means is so shaped and the ledge is so shaped that the ledge return means discontinues application of force to the support ledge shortly before the support ledge reaches the position of rest.

20. The ledge of claim 19, wherein the support ledge return means has a maximum stroke and the support ledge has a maximum stroke of movement, and the maximum stroke of the ledge return means is less than the maximum stroke of the movable support ledge.

* * * * *